US010161071B2

(12) United States Patent
Lee et al.

(10) Patent No.: US 10,161,071 B2
(45) Date of Patent: Dec. 25, 2018

(54) WASHING MACHINE

(71) Applicant: LG ELECTRONICS INC., Seoul (KR)

(72) Inventors: Sanghyun Lee, Seoul (KR); Naeun Kim, Seoul (KR); Sunho Lee, Seoul (KR); Bonkwon Koo, Seoul (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 14/923,830

(22) Filed: Oct. 27, 2015

(65) Prior Publication Data

US 2016/0115635 A1 Apr. 28, 2016

(30) Foreign Application Priority Data

Oct. 27, 2014 (KR) ..... 10-2014-0146383

(51) Int. Cl.
*D06F 33/02* (2006.01)
*D06F 39/08* (2006.01)
(Continued)

(52) U.S. Cl.
CPC ..... *D06F 33/02* (2013.01); *D06F 39/083* (2013.01); *D06F 39/085* (2013.01);
(Continued)

(58) Field of Classification Search
CPC ..... D06F 23/04; D06F 39/003; D06F 39/083; D06F 39/085; D06F 39/088; D06F 33/02;
(Continued)

(56) References Cited

U.S. PATENT DOCUMENTS 7,810,362 B2 * 10/2010 Harwood ..... D06F 33/02 68/12.01
9,109,321 B2 * 8/2015 Hettinger ..... D06F 39/088
(Continued)

FOREIGN PATENT DOCUMENTS

EP 2752515 7/2014
EP 2752514 A * 9/2014
(Continued)

OTHER PUBLICATIONS

Machine translation of JP 2010-046125, no date.*
(Continued)

*Primary Examiner* — Joseph L. Perrin
(74) *Attorney, Agent, or Firm* — Fish & Richardson P.C.

(57) ABSTRACT

A washing machine is disclosed. The washing machine includes an outer tub that is configured to hold water. The washing machine further includes an inner tub that is located in the outer tub and that is configured to hold laundry and spin. The washing machine further includes a circulation flowpath that is configured to circulate water discharged from the outer tub. The washing machine further includes a first nozzle that is configured to jet water supplied from the circulation flowpath to the inner tub. The washing machine further includes an adjustable pump that is configured to pump water through the circulation flowpath to the first nozzle, the adjustable pump being configured to adjust flow of water to the first nozzle.

8 Claims, 11 Drawing Sheets

(51) Int. Cl.
*D06F 23/04* (2006.01)
*D06F 39/00* (2006.01)

(52) U.S. Cl.
CPC ..... *D06F 39/088* (2013.01); *D06F 23/04* (2013.01); *D06F 39/003* (2013.01); *D06F 2202/10* (2013.01); *D06F 2204/06* (2013.01); *D06F 2204/082* (2013.01); *D06F 2204/084* (2013.01); *D06F 2204/086* (2013.01)

(58) Field of Classification Search
CPC ..... D06F 2202/10; D06F 2204/06; D06F 2204/082; D06F 2204/084; D06F 2204/086
See application file for complete search history.

(56) References Cited

U.S. PATENT DOCUMENTS

| | | | | |
|---|---|---|---|---|
| 2010/0236001 | A1* | 9/2010 | Lee | D06F 33/02 8/159 |
| 2012/0060300 | A1* | 3/2012 | Kim | D06F 23/04 8/137 |
| 2012/0240638 | A1* | 9/2012 | Hettinger | D06F 39/088 68/200 |
| 2013/0086754 | A1* | 4/2013 | Hendrickson | D06F 39/003 8/137 |

FOREIGN PATENT DOCUMENTS

| | | | | |
|---|---|---|---|---|
| JP | H09234297 | | 9/1997 | |
| JP | 2010036016 | | 2/2010 | |
| JP | 20100460125 | * | 3/2010 | |
| KR | 10-1996-0037945 | | 11/1996 | |
| KR | 10-1997-0027459 | | 6/1997 | |
| KR | 10-0280605 | | 2/2001 | |
| KR | 10-0889817 | | 3/2009 | |
| KR | 10-0891912 | | 4/2009 | |
| KR | 10-2011-0043251 | | 4/2011 | |
| KR | 10-2012-0027819 | | 3/2012 | |
| WO | WO 2014131452 A1 | * | 9/2014 | D06F 39/083 |

OTHER PUBLICATIONS

Machine translation of JP 2010-036016A to Panasonic Corp. (Year: 2010).*
European Extended Search Report in European Application No. 15855335.4, dated Jun. 20, 2018, 7 pages.

* cited by examiner first rinsing second rinsing third rinsing

WASHING MACHINE

CROSS-REFERENCE TO RELATED APPLICATION

This application claims priority to Korean Patent Application No. 10-2014-0146383, filed on Oct. 27, 2014 in the Korean Intellectual Property Office, whose entire disclosure is incorporated herein by reference.

FIELD

The present disclosure relates to washing machines.

BACKGROUND

Generally, a washing machine is an apparatus that cleans laundry through softening by detergent, waterjet created as the washing tub or wings spin, and impacts by the washing wings, and proceeds with washing, rinsing, and/or dehydrating to rid contaminants of the clothes (or laundry) using the action between the detergent and water. A washing machine includes an outer tub retaining water and an inner tub rotatably provided in the outer tub and containing clothes (or laundry). The washing machine further includes a circulation flowpath for circulating discharged water and sending back to the inner tub and a nozzle for jetting the water from the circulation flowpath back to the inner tub. A circulation pump may also be provided to force the water to be sent along the circulation flowpath.

SUMMARY

Conventional circulation pumps may have a constant-RPM motor supply, a constant flowrate of water to the nozzle, and at a constant water pressure. In these examples, the circulation pumps keep the span of water jetted through the nozzle constant. The constant jet span, however, may fail to sufficiently soak laundry in an inner tub of a washing machine depending on the volume of the laundry. For example, when a large load of laundry is put in the inner tub, orienting the waterjet to an upper side would lead to more effective soaking of the laundry directly in the water jetted from the nozzle as compared with when the amount of laundry is small. The conventional pumps may fail to account for such a difference in laundry soak because the jet span of nozzle remains unchanged.

An innovative aspect of the subject matter described in this specification may be implemented in a washing machine that includes an outer tub that is configured to hold water; an inner tub that is located in the outer tub and that is configured to hold laundry and spin; a circulation flowpath that is configured to circulate water discharged from the outer tub; a first nozzle that is configured to jet water supplied from the circulation flowpath to the inner tub; and an adjustable pump that is configured to pump water through the circulation flowpath to the first nozzle, the adjustable pump being configured to adjust flow of water to the first nozzle.

These and other implementations can each optionally include one or more of the following features. The washing machine further includes a laundry load sensor that is configured to sense a laundry load in the inner tub; and a controller that is configured to control a rotation speed of the adjustable pump based on the sensed laundry load. The controller is configured to increase the rotation speed of the adjustable pump based on the laundry load sensed by the laundry load sensor increasing. The controller is configured to classify the laundry load sensed by the laundry load sensor into two or more categories; and control the rotation speed of the adjustable pump based on the two or more categories. The controller is configured to increase the rotation speed of the adjustable pump based on the sensed laundry load increasing.

The washing machine further includes a pulsator that is configured to spin and that is located in the inner tub; and an actuator that is configured to rotate the pulsator. The controller is configured to control the actuator to perform agitated washing by alternatively spinning the pulsator in two directions, and control the rotation speed of the adjustable pump based on the laundry load sensed by the laundry load sensor during agitated washing. The controller is configured to increase the rotation speed of the adjustable pump based on the laundry load sensed by the laundry load sensor increasing. The controller is configured to classify the laundry load sensed by the laundry load sensor into two or more categories; and control the rotation speed of the pump based on the two or more categories. The controller is configured to increase the rotation speed of the adjustable pump based on the sensed laundry load increasing.

The washing machine further includes an actuator that is configured to rotate the inner tub; a laundry load sensor that is configured to sense a laundry load in the inner tub; and a controller that is configured to perform compressed washing by controlling a rotation speed of the actuator based on the laundry load sensed by the laundry load sensor and by forcing the laundry load against the inner tube by rotation of the laundry together with the inner tub, and operate the adjustable pump during compressed washing based on the sensed laundry load being smaller than a predetermined level. The outer tub is configured to hold water without contacting a top of the inner tub during the compressed washing where water ascends between the outer tub and the inner tub. The controller is configured to spin the actuator in one direction during the compressed washing.

The washing machine further includes a second nozzle that is configured to jet water supplied from an external water source to the inner tub; and a detergent supplying unit that is configured to receive detergent and provide the detergent to the inner tub; and direct water supplied from the external water source through the detergent supplying unit to the inner tub. After draining the outer tub, rinsing the laundry, the rinsing including supplying water through the detergent supplying unit and the second nozzle, operating the adjustable pump for a predetermined time after supplying water, draining the outer tub, and after draining the outer tub, resupplying water through the second nozzle. At least one of an upper limit of a jet spray and horizontal jet spray of the first nozzle varies depending on a pressure of water supplied.

The first nozzle includes a collision surface that is configured to jet water supplied through the circulation flowpath downward; and constrain a height of water jetted based on the water being supplied at a particular water pressure or greater. The first nozzle includes a pipe part that is connected with the circulation flowpath; and a flowpath that includes an area increasing from an inlet through which water comes in from the pipe part to an outlet that is configured to discharge water to the inner tub. At least a portion of an inner circumferential surface defined by the flowpath defines the collision surface. A jet direction of the first nozzle is at least partially oriented toward a side wall of the inner tub.

An object of the subject matter described in this application is to provide a washing machine that circulates/jets water in the outer tub using an RPM-adjustable motor.

BRIEF DESCRIPTION OF THE DRAWINGS

FIG. 4(*b*) is a side, cross-sectional view of a first nozzle.

FIG. 5(*b*) is a view of example jet widths of a first nozzle for the upper limits.

FIG. 7(*b*) is a view of example jet widths of a first nozzle for the upper limits.

FIG. 9(*b*) is an example view of compression washing being performed at a high water level.

DETAILED DESCRIPTION

Figure 1:
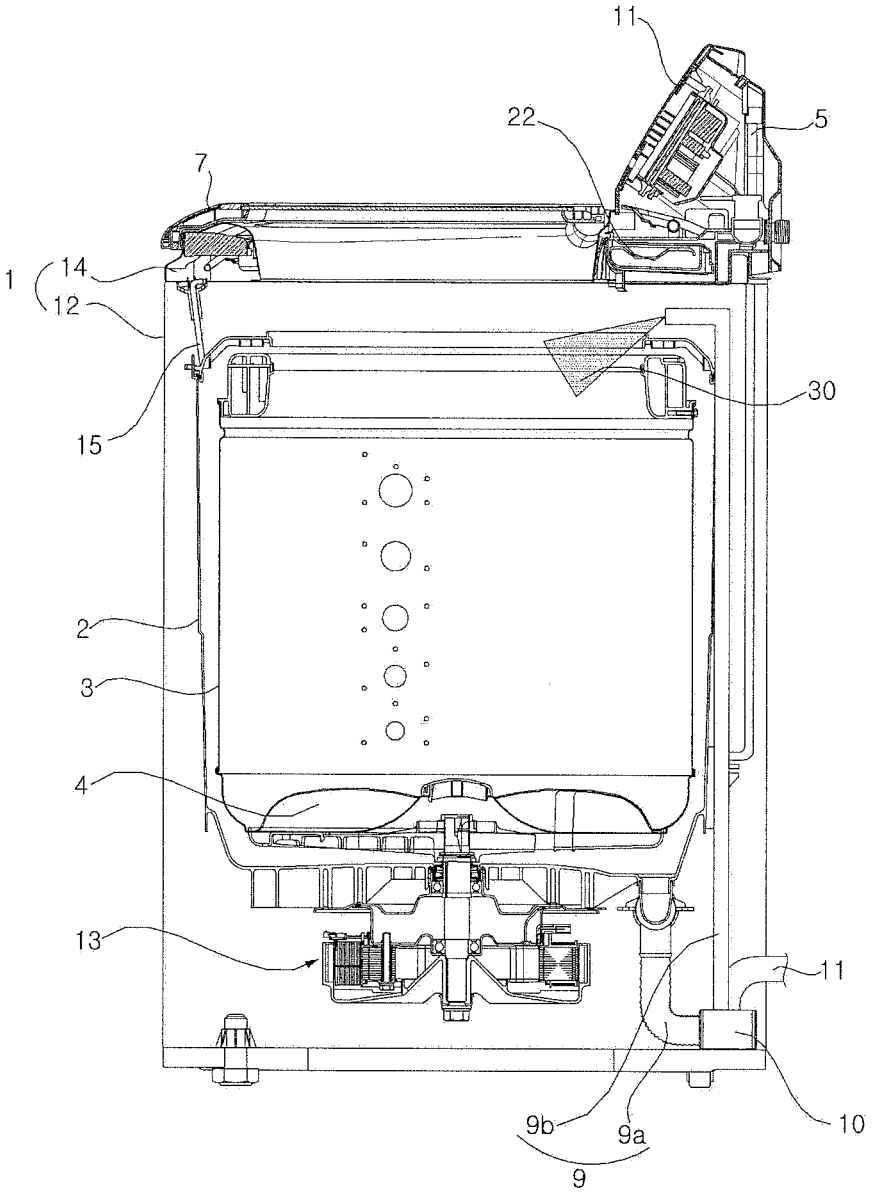
FIG. 1 is a side, cross-sectional view of an example washing machine.
Figure 2:
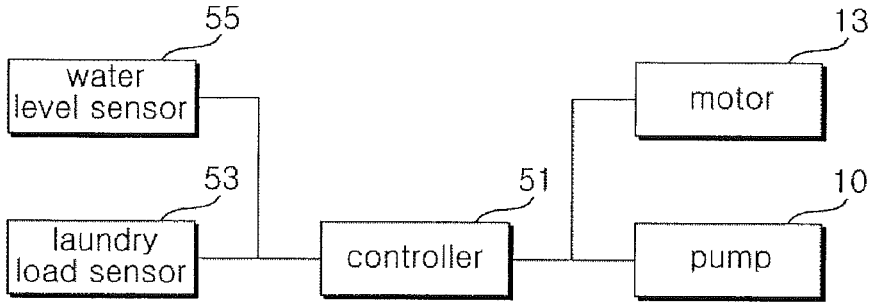
FIG. 2 is a block diagram of an example control relationship between main parts of a washing machine.
Figure 3:
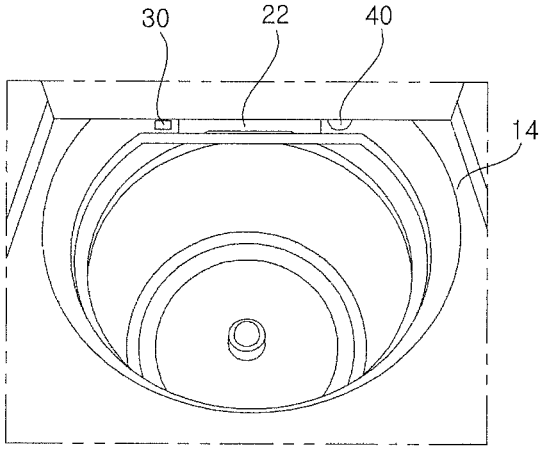
FIG. 3 is a view from above an example washing machine.
Figure 4A:
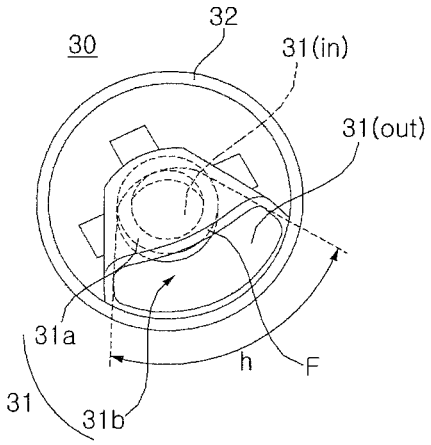
FIG. 4(*a*) is a front view of an example first nozzle.
Figure 4B:
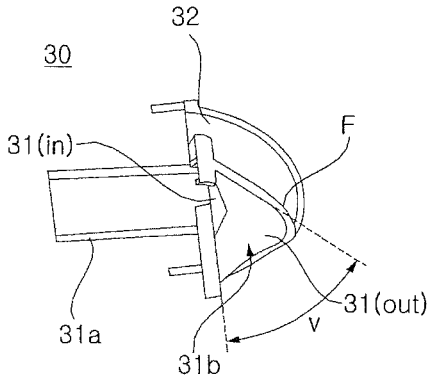

FIG. 1 illustrates an example washing machine. FIG. 2 illustrates an example control relationship between main parts of a washing machine. FIG. 3 illustrates an example washing machine. FIGS. 4(*a*) and 4(*b*) illustrate an example first nozzle.

Referring to FIGS. 1 to 4, the washing machine includes a casing 1 forming its outer look, a control panel 11 including manipulation keys to receive various control commands from the user and a display to display information on the operation state of the washing machine to provide a user interface, and a door 7 pivotally provided to the casing 1 to open or close an entrance/exit hole through which clothes (or laundry) are put in or pulled out.

An outer tub 2 where water is contained is hung inside the casing 1 by a supporting rod 15. The outer tub 2 includes an inner tub 3 spinnable about the center of a vertical axis. A pulsator 4 is spinnably provided on the bottom of the inner tub 3. The inner tub 3 includes a plurality of holes through which washing water passes.

The casing 1 may include a cabinet 12 having an opening at its top and a top cover 14 provided over the cabinet 12 and having an entrance/exit hole substantially at the center thereof to allow for entrance/exit of laundry.

A water supply flowpath 5 is connected with an external water source, e.g., a faucet, to supply water to the outer tub 2 and/or inner tub 3. The water supply flowpath 5 may supply water to a detergent supplying unit 22 and/or a second nozzle 40 that are described below.

The detergent supplying unit 22 provides a space to receive a detergent that is put in the inner tub 3 and allows water from the external water source to be supplied to the inner tub 3 via the space. The detergent supplying unit 22 may include a container that receives a detergent and that may be provided to be withdrawn from the casing 1. One or more valves may be provided along the water supply flowpath 5 to switch on/off the water supply to the detergent supplying unit 22 or the second nozzle 40.

A first nozzle 30, second nozzle 40, and detergent supplying unit 22 should be disposed where they are not interfered with by the inner tub 3 spinning, and in some implementations, they are disposed in the top cover 14 as shown in FIG. 3. In some implementations, the first nozzle 30 or the second nozzle 40 may be disposed in the outer tub 2.

An actuator 13 puts the inner tub 3 and/or pulsator 4 in operation. The actuator 13 may include a motor to provide a rotational force and a clutch mechanism to selectively transfer the rotational force from the motor to the inner tub 3 and the pulsator 4. In particular, the motor has a dehydration shaft and a washing shaft that share the same rotation center. The washing shaft transfers a rotational force to the pulsator 4, and the dehydration shaft transfers a rotational force to the inner tub 3. As the motor is spun by a proper operation of the clutch mechanism while the washing shaft is separated from the dehydration shaft, only the pulsator 4 is rotated by the washing shaft, and as the motor is spun while the washing shaft is engaged with the dehydration shaft, the pulsator 4 and the inner tub 3 spin together.

There may be provided a circulation flowpath 9 to circulate water discharged and a pump 10 to forcedly supply water to the first nozzle 30 through the circulation flowpath 9.

The circulation flowpath 9 may include a water discharge bellows 9*a* to guide water discharged from the outer tub 2 to the pump 10 and a circulation pipe 9*b* to guide the water forcedly transferred by the pump 10 to the first nozzle 30.

The pump 10 may adjust the flow rate. The pump 10 may include a speed-controllable motor and an impeller spun by the motor. The speed-controllable motor may include, but is not limited to a permanent magnet synchronous motor (PMSM), a brushless DC electric motor (BLDC), etc.

In some implementations, the pump 10 also enables water drainage and is used for the purpose of draining the outer tub 2 away through the water drain hose 11. The pump 10 may include a switching valve that switches on/off the water flowpath to allow water discharged from the outer tub 2 through the water discharge bellows 9*a* to be selectively carried to the circulation pipe 9*b* or water drain hose 11. Without limited thereto, however, a water drain pump may be provided to drain the outer tub 2 separately from the pump 10.

A laundry load sensor 53 senses the amount of laundry put in the inner tub 3—hereinafter, the amount of laundry is referred to as a laundry load. The laundry load sensor 53 may estimate a laundry load in the principle that the inner tub 3 exhibits different degrees of inertia depending on the load of laundry put in. For example, since the inertia at rest of the inner tub 3 increases as the laundry load goes up, a more electric current or electromotive force is required to actuate the inner tub 3 at rest. Accordingly, the laundry load may be calculated by measuring such values. In another way, from the perspective that the rotational inertia varies depending on the laundry load, a laundry load may be calculated by measuring a counter-electromotive force created when bringing the spinning inner tub 3 to a stop or by measuring the time taken until it comes to a stop. Without limited thereto, however, various methods to sense a laundry load are known in the washing machine industry. The laundry load sensor 53 may sense a laundry load by a known method.

Referring to FIGS. 4(*a*) and 4(*b*), the first nozzle 30 may be configured so that at least one of the upper limit of jet span and the horizontal jet span may be varied depending on the pressure of water supplied.

The first nozzle 30 may include a nozzle body 31 to jet water and a nozzle cover 32 to fix the nozzle body 31 at a predetermined jet direction.

The nozzle body 31 may include a collision surface F where water supplied through the circulation flowpath 9 hits and jets downward and which constrains the largest height of water jetted when the water is supplied at a sufficient water pressure.

The nozzle body 31 may include a pipe part 31*a* connected with the circulation flowpath 9 and a nozzle part 31*b* having an inlet 31(in) through which water comes in from the pipe part 31*a* and an outlet 31(out) to discharge water to the inner tub 3. The nozzle part 31*b* may be shaped as a funnel that increases the area of flowpath from the inlet 31(in) towards the outlet 31(out). At least a portion of the inner circumferential surface forming the flowpath forms the collision surface F.

The upper limit of the jet span of the nozzle body 31 is determined by the water flow jetted substantially in a tangential direction along the collision surface F if the pump 10 supplies water at a sufficient water pressure (or flow rate), and the water flow is gradually oriented downwards as the water pressure decreases. The upper limit of jet span of the nozzle body 31 may vary depending on the water pressure within an angle V marked in FIG. 4(*b*).

Further, the horizontal jet span of the nozzle body 31 may vary depending on the water pressure (or flow rate) applied by the pump 10, in particular, within the range marked with "h" in FIG. 4(*a*) corresponding to the left-right border of the outlet 31(out).

In some implementations, the jet direction of the nozzle body 31 is at least partially oriented to a side wall of the inner tub 3. It allows the laundry to be evenly soaked when the inner tub 3 spins while the laundry is placed at an unbalanced position pushed to the side wall of the inner tub 3.

The nozzle cover 32 is coupled with the top cover 14 while covering the top of the nozzle body 31. The nozzle cover 32 spins together with the nozzle body 31. Thus, the jet direction of the nozzle body 31 is determined by the degree of rotation of the nozzle cover 32 coupled with the top cover 14.

Figure 5A:
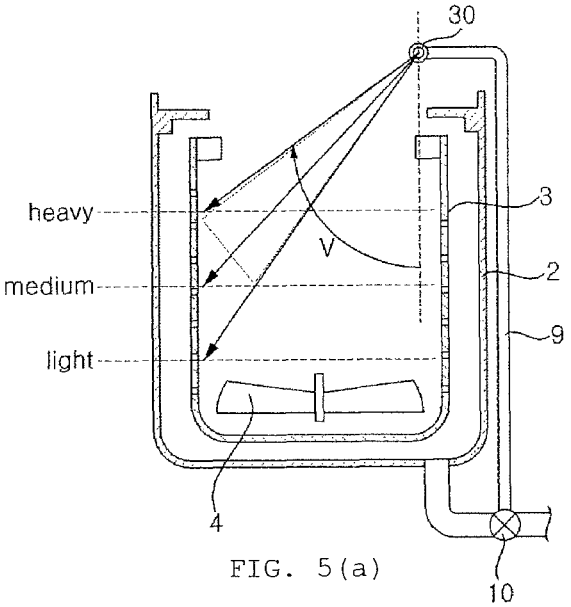
FIG. 5(*a*) is a view of upper limits of example jet spans of a first nozzle that vary depending on the load of laundry.
Figure 5B:
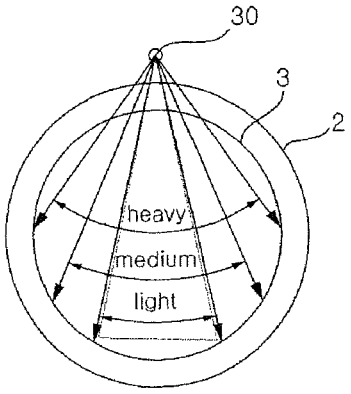

FIG. 5(*a*) illustrates an upper limit of an example jet span of a first nozzle, and FIG. 5(*b*) illustrates an example jet span of the first nozzle. Referring to FIGS. 5(*a*) and 5(*b*), a controller 51 may control the flow rate of the pump 10 according to a laundry load sensed by the laundry load sensor 53. In some implementations, it is possible to sense a laundry load while the laundry remains dried before water supply, but without limited thereto, it may also be sensed when the laundry becomes wet after dehydration or drain is done.

The controller 51 may perform control so that the flow rate of the pump 10 increases as more laundry is sensed by the laundry load sensor 53 and decreases as less laundry is sensed. For a reason, if the inner tub 3 spins with a high load of laundry put in, the laundry may reach a higher position on the side wall of the inner tub 3 as compared with when a smaller amount of laundry is loaded, and the flow rate of the pump 10 may be thus increased. This may lead to an increased jet width and span of the first nozzle 30.

Meanwhile, the controller 51 may divide the laundry load sensed by the laundry load sensor 53 into two or more categories and may control the flow rate of the pump 10 depending on the categories. For example, as shown in FIGS. 5(*a*) and 5(*b*), a laundry load may come in three categories: heavy, medium, and light. From light to heavy, the flow rate of the pump 10 may be controlled to increase.

Figure 6:
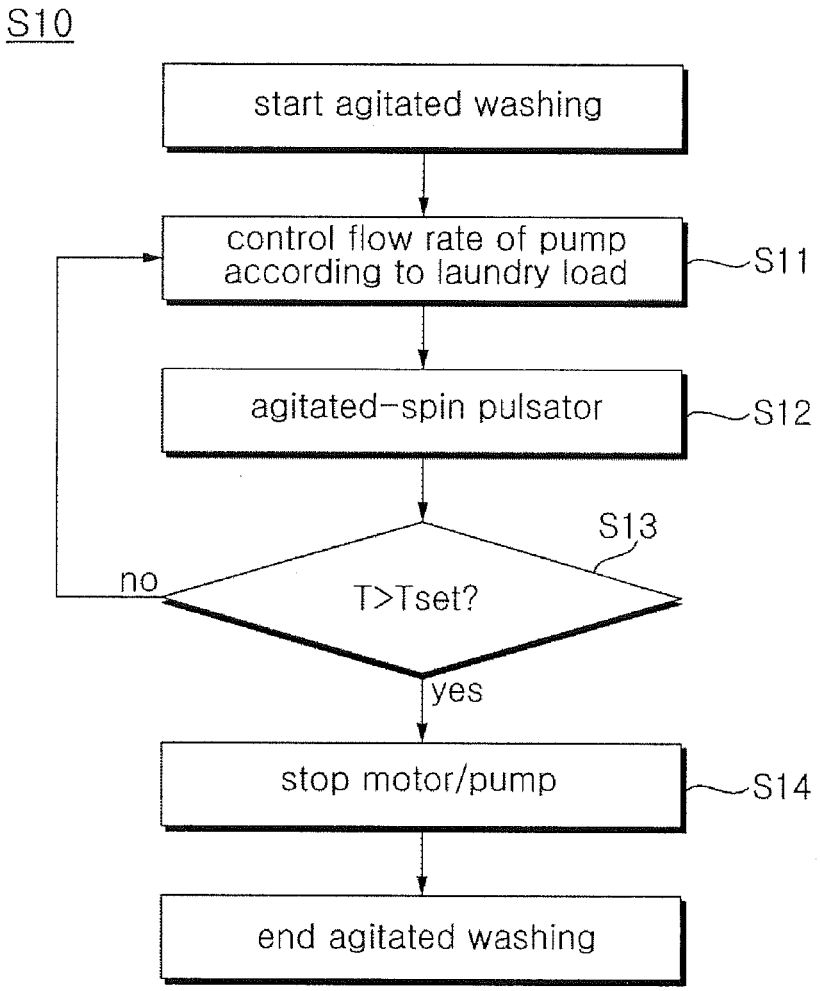
FIG. 6 is a flowchart of an example method for controlling a washing machine upon agitation washing.
Figure 7A:
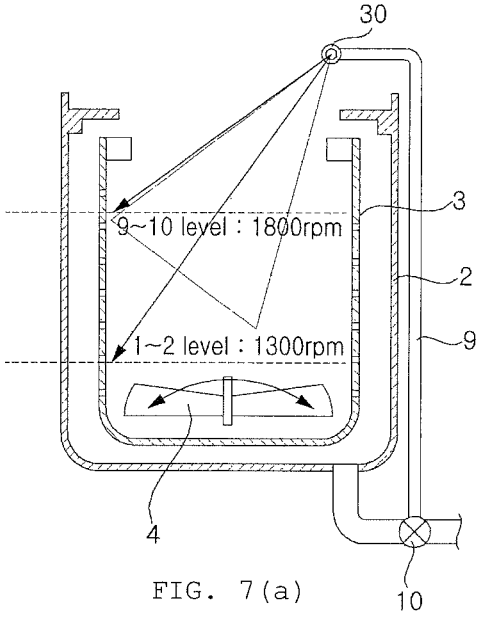
FIG. 7(*a*) is a view of upper limits of example jet spans of a first nozzle upon agitation washing.
Figure 7B:
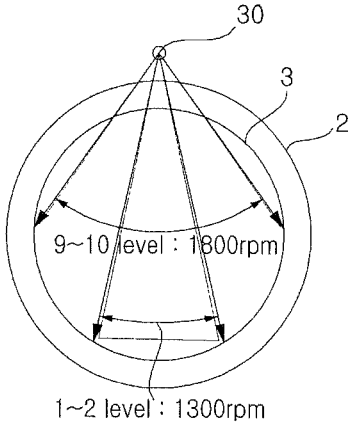

FIG. 6 illustrates an example method for controlling a washing machine upon agitation washing. FIG. 7(*a*) illustrates upper limits of example jet spans of a first nozzle upon agitation washing, and FIG. 7(*b*) illustrates example jet widths of the first nozzle for the upper limits Here, FIGS. 6 to 7(*b*) are referenced.

Agitated washing S10 is a process of cleaning laundry while spinning the pulsator 4 at a short period of time alternately in two directions (agitated spinning, S12). Upon agitated washing, the controller 51 may control the flow rate of the pump 10 according to the laundry load sensed by the laundry load sensor 53 (S11). Step S11 may include a sub-step for setting up a flow rate depending on a laundry load and a sub-step for actuating the pump 10 depending on the flow rate setup. It is enough for the pump 10 to be actuated while the pulsator 4 is agitated-spun, and the pump 10 may begin to operate before or during the agitated spinning (S12).

In step S11, the rotational speed (e.g., the RPM of the motor) may be set depending on the laundry load. Here, the controller 51 may categorize the laundry load sensed by the laundry load sensor 53 depending on its size and may control the RPM of the pump 10 into 1300 rpm to 1800 rpm depending on the categories.

For instance, the laundry load sensor 53 may sense a laundry load at level 1 to level 10. The controller 51 may group two levels into a single category, thus coming up with five categories from category 1, a group of level 1 and level 2, to category 5, a group of level 9 and level 10, and the controller 51 may set an RPM of the pump 10 for each category. In some implementations, the RPM of the pump 10 may be set to 1300 rpm for category 1 (levels 1 and 2) and 1800 rpm for category 5 and may be stepwise increased from 1300 rpm to 1800 rpm for categories 2 to 4.

When the time during which the pulsator 4 has agitated-spun passes a preset time Tset (S13), the controller 51 may put the actuator 13 and the pump 10 to a stop (S14).

For the purpose of energy and water savings, when water supply is reduced and agitated washing is performed at a lower water level, the laundry positioned at an upper side may be readily exposed to the air, and the contaminant sticking to the laundry may be hardened, deteriorating the washing capability. In some implementations, such issue may be addressed by jetting water through the first nozzle 30 upon agitated washing. In particular, the laundry may be more effectively soaked by controlling the flow rate of the pump 10 depending on the laundry load.

Figure 8:
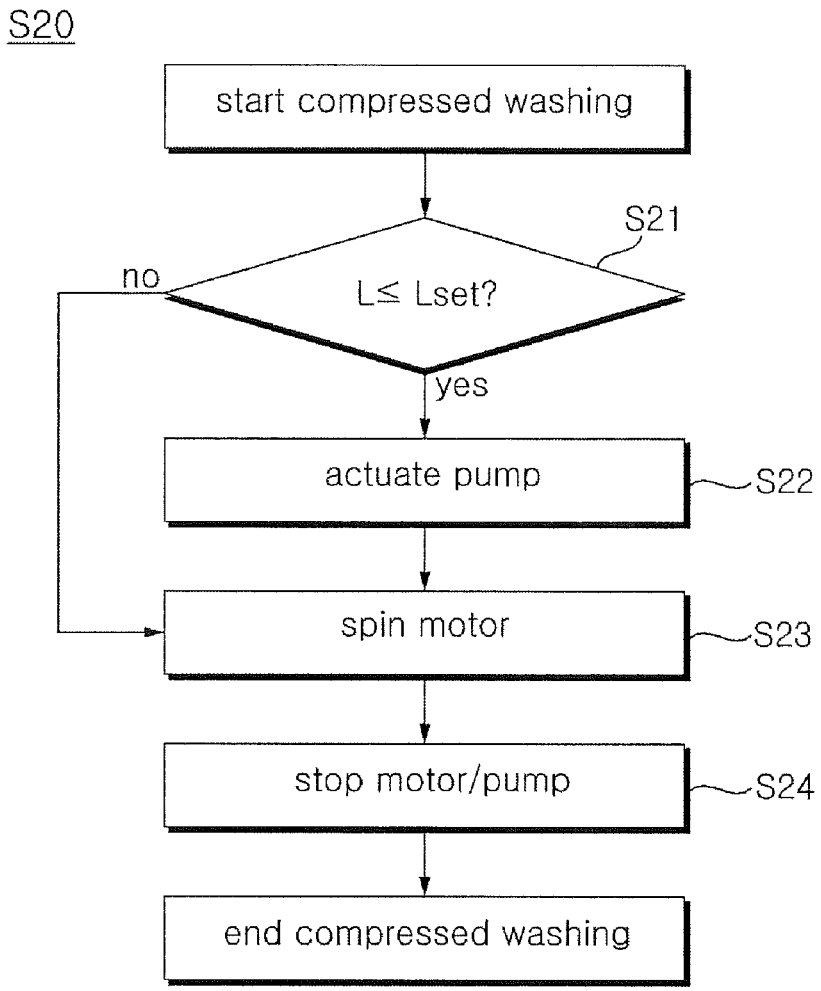
FIG. 8 is a flowchart of an example method for controlling a washing machine upon compression washing.
Figure 9A:
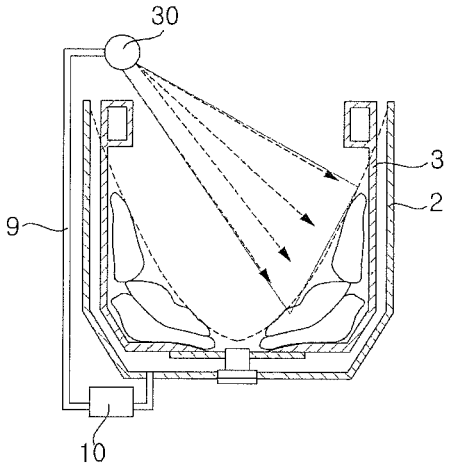
FIG. 9(*a*) is an example view of compression washing being performed at a low water level.
Figure 9B:
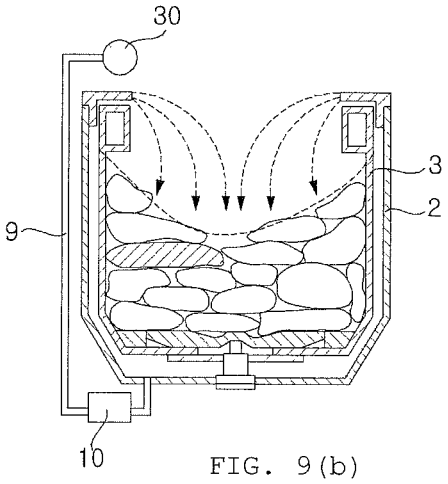

FIG. 8 illustrates an example method for controlling a washing machine upon compression washing. FIG. 9 illustrates an example comparison between (a) when compression washing is performed at a lower water level and (b) when compression washing is performed at a higher water level. Here, FIGS. 8 and 9 are referenced.

Compressed washing S20 is a process in which cleaning is carried out while the inner tub 3 spins with the laundry sticking to the side wall of the inner tub 3. Here, the controller 51 enables the laundry to be spun together with the inner tub 3 while stuck to the inner tub 3 by the centrifugal force by controlling the spinning of the actuator 13 according to the laundry load sensed by the laundry load sensor 53. In some implementations, the actuator 13 steadily spins in one direction (S23).

Meanwhile, the compressed washing may be fulfilled in two aspects respectively as shown in FIGS. 9(*a*) and 9(*b*), depending on the water level of the outer tub 2. Referring to FIG. 9(*a*), the case of a light laundry load and thus a lower water level (assuming that the amount of water supplied to the outer tub 2 is proportional to the laundry load), the laundry is stuck to the side wall of the inner tub 3 as the inner tub 3 spins, but the water ascended between the outer tub 2 and the inner tub 3 by the centrifugal force does not go beyond the top of the inner tub 3. In some implementations, since the water contained in the outer tub 2 and the inner tub 3 cannot involve washing, the washing capability may end up deteriorating.

To straighten out this issue, the controller 51 may control the pump 10 to operate during the compressed washing if the laundry load L sensed by the laundry load sensor 53 is smaller than a predetermined level Lset (S21 and S22). Even at a light laundry load (e.g., at a lower water level), the laundry may be effectively soaked by water jetted through the first nozzle 30.

In some implementations, the laundry load L is determined to be larger than the predetermined level Lset in step S21, e.g., the water level of the outer tub 2 is relatively high, the water moved up between the outer tub 2 and the inner tub 3 goes beyond the top of the inner tub 3 and drops back to the inner tub 3 as shown in FIG. 9(*b*). In some implementations, only the actuator 13 is spun without the pump 10 being operated (S23).

Figure 10:
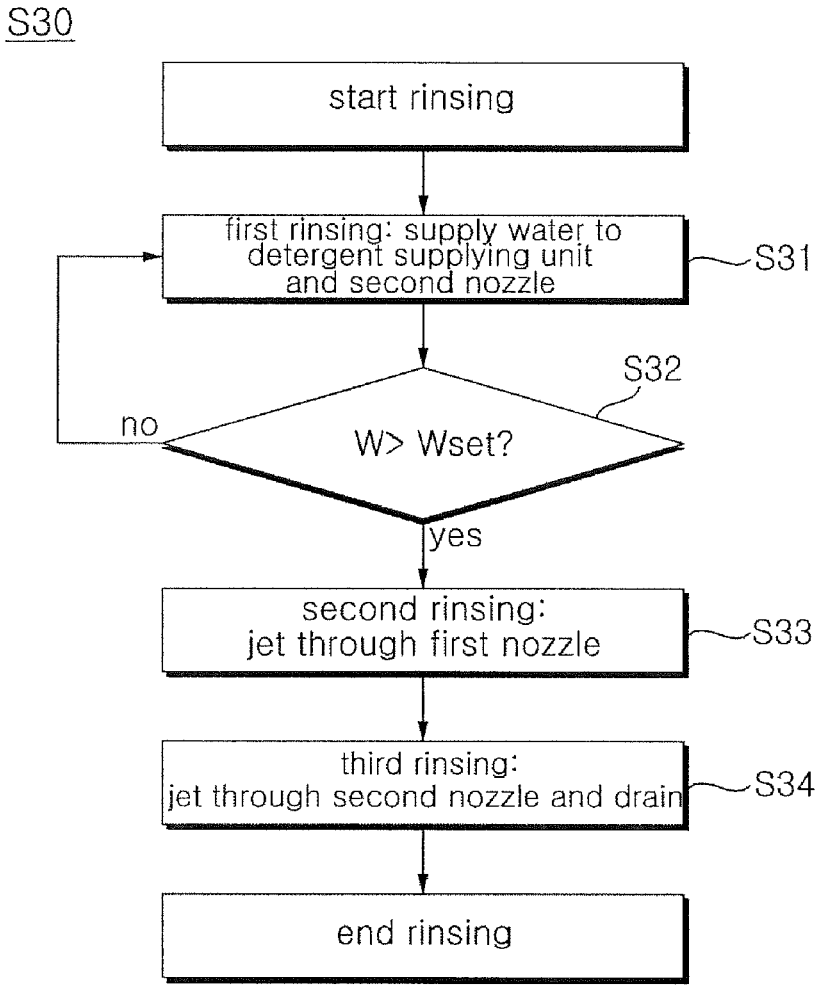
FIG. 10 is a flowchart of an example method for controlling a washing machine upon rinsing.
Figures 11A, 11B, 11C:
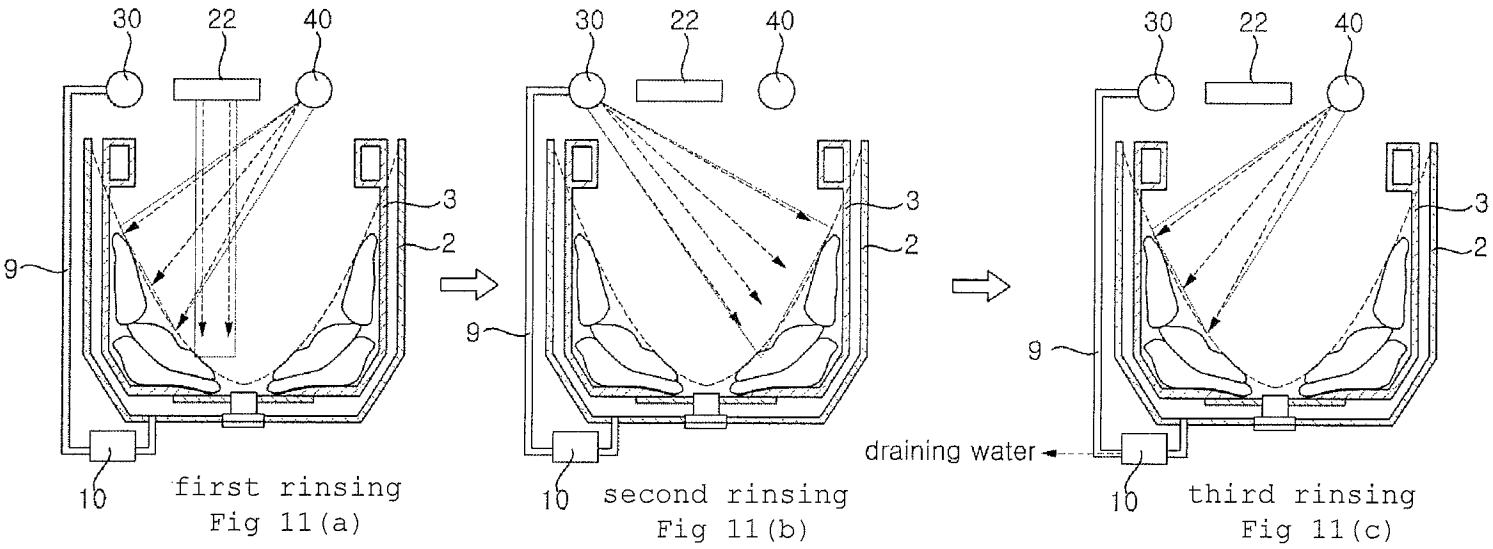
FIGS. 11(*a*), 11(*b*), and 11(*c*) are example views of a sequential rinsing process.

FIG. 10 illustrates an example method for controlling a washing machine upon rinsing. FIG. 11 illustrates an example sequential rinsing process as illustrated in FIG. 10. Here, FIGS. 10 and 11 are referenced.

Rinsing is a process in which, after draining the outer water 2, water supply resumes to rinse the washing water. In the conventional rinsing process, water from an external water source is jetted through a nozzle while drain is simultaneously done. Accordingly, such event sometimes arises where a portion of water drains out without hitting the laundry, deteriorating the rinsing capability.

To respond to such issue, the rinsing S30 is carried out after washing and draining the outer tub 2 and includes a first rinsing step S31 (FIG. 11(*a*)) for supplying water to the outer tub 2 through the detergent supplying unit 22 and the second nozzle 40, a second rinsing step S33 (FIG. 11(*b*)) of actuating the pump 10 for a predetermined time after the water supply through the second nozzle 40 and the detergent supplying unit 22 is done to jet water through the first nozzle 30, and a third rinsing step S34 (FIG. 11(*c*)) for resuming water supply through the second nozzle 40 after draining the outer tub 2.

The second rinsing step S33 is fulfilled after the water level W in the outer tub 2 is rendered to reach a targeted level Wset by the water supplied in the first rinsing step S31 (e.g., water drain is not performed in the first rinsing step S31). To sense the water level in the outer tub 2, a flowmeter to sense the amount of water supplied or a water level sensor 55 to sense the water level may be provided, and in some implementations, the controller 51 may control the water supply in the first rinsing step S31 according to the value sensed by the flowmeter or water level sensor 55.

The washing machine may vary the jet span of the nozzle jetting water discharged from the outer tub and being in circulation, thereby reducing an unbalance in washing or rinsing depending on the laundry load. In particular, the washing machine may evenly soak the laundry regardless of the laundry load.

Further, the washing machine may control the RPM of the pump supplying water to the nozzle even though the nozzle is oriented in a fixed jet direction. Accordingly, the washing machine may vary the jet width and upper limit of jet span of the nozzle by controlling the flow rate or water pressure of water supplied through the nozzle.

What is claimed is:

1. A washing machine, comprising:
- an outer tub that is configured to hold water;
- an inner tub that is located in the outer tub and that is configured to hold laundry and spin;
- a circulation flowpath that is configured to circulate water discharged from the outer tub;
- a first nozzle that is configured to jet water supplied from the circulation flowpath to the inner tub;
- a pump that is configured to pump water through the circulation flowpath to the first nozzle;
- an actuator that is configured to rotate the inner tub;
- a laundry load sensor that is configured to sense a laundry load in the inner tub; and
- a controller that is configured to control a rotation speed of the pump and that is configured to perform a first washing based on the laundry load sensor sensing a first laundry load that is less than a predetermined level and perform a second washing based on the laundry load sensor sensing a second laundry load that is greater than the predetermined level,
- wherein the first washing includes:
  - performing a compressed washing by controlling a rotation speed of the actuator and by forcing the laundry load against the inner tub by rotation of the laundry load together with the inner tub; and
  - operating the pump during the compressed washing, and
- wherein the second washing includes:
  - controlling a rotation speed of the actuator where water between the outer tub and the inner tub ascends and drops into the inner tub and while the pump is not operated.

2. The washing machine of claim 1, wherein the controller is configured to spin the actuator in one direction during the compressed washing.

3. The washing machine of claim 1, further comprising:
- a second nozzle that is configured to jet water supplied from an external water source to the inner tub; and
- a detergent supplying unit that is configured to:
  - receive detergent and provide the detergent to the inner tub; and
  - direct water supplied from the external water source through the detergent supplying unit to the inner tub,
- wherein the pump is configured to adjust a rotation speed, and
- wherein, after draining the outer tub, rinsing the laundry, the rinsing comprises:
  - supplying water through the detergent supplying unit and the second nozzle,
  - operating the pump for a predetermined time after supplying water,
  - draining the outer tub, and
  - after draining the outer tub, resupplying water through the second nozzle.

4. The washing machine of claim 1, wherein at least one of an upper limit of a jet spray and horizontal jet spray of the first nozzle varies depending on a pressure of water supplied.

5. The washing machine of claim 4, wherein the first nozzle includes a collision surface that is configured to:

jet water supplied through the circulation flowpath downward; and constrain a height of water jetted based on the water being supplied at a particular water pressure or greater.

6. The washing machine of claim 5, wherein the first nozzle includes:

a pipe part that is connected with the circulation flowpath; and a flowpath that includes an area increasing from an inlet through which water comes in from the pipe part to an outlet that is configured to discharge water to the inner tub, wherein at least a portion of an inner circumferential surface defined by the flowpath defines the collision surface.

7. The washing machine of claim 1, wherein a jet direction of the first nozzle is at least partially oriented toward a side wall of the inner tub.

8. The washing machine of claim 1, wherein:

the pump includes a motor, and the controller controls the rotation speed of the pump by controlling a rotation speed of the motor.

* * * * *